United States Patent [19]

Lewis

[11] Patent Number: 4,986,395

[45] Date of Patent: Jan. 22, 1991

[54] COMBINED SUITCASE AND PORTABLE IRONING BOARD

[76] Inventor: Walter M. Lewis, 94 Pond St., New Haven, Conn. 06511

[21] Appl. No.: 435,756

[22] Filed: Nov. 14, 1989

[51] Int. Cl.[5] ..... A47B 85/00; A45G 9/00

[52] U.S. Cl. ..... 190/1; 190/11; 190/18 A; 190/18 R; 38/112; 38/139; 38/140

[58] Field of Search ..... 190/1, 11, 12, 13 D, 190/18 A, 18 R; 38/112, 140, 139

[56] References Cited

U.S. PATENT DOCUMENTS

| | | | |
|---|---|---|---|
| 336,347 | 2/1886 | Rice | 190/11 X |
| 1,211,829 | 1/1917 | Eades | 190/11 |
| 1,792,714 | 2/1931 | Shields | 190/11 X |
| 2,609,072 | 9/1952 | Levinson | 190/11 |
| 2,649,137 | 8/1953 | Roberts | 38/112 X |
| 2,729,905 | 1/1956 | Crozier | 190/11 X |
| 3,027,664 | 4/1962 | Dailey | 38/112 X |
| 3,049,825 | 8/1962 | Boyd | 190/11 X |
| 3,326,337 | 6/1967 | Bell | 190/11 |
| 3,512,620 | 5/1970 | Bell et al. | 190/11 |
| 3,516,523 | 6/1970 | Pemberton, Jr. | 190/11 |
| 3,732,639 | 5/1973 | Elder | 190/11 X |
| 3,923,356 | 12/1975 | Washburne | 190/11 X |
| 4,034,518 | 7/1977 | Trecker | 190/11 X |
| 4,412,604 | 11/1983 | Bell et al. | 190/11 |
| 4,813,116 | 3/1989 | Drake | 38/140 |
| 4,856,627 | 8/1989 | Polatov | 190/11 |

*Primary Examiner*—Sue A. Weaver

*Attorney, Agent, or Firm*—John R. Doherty

[57] ABSTRACT

A combined suitcase and portable ironing board comprising a pair of suitcase sections each including a closed end surrounded by side walls and an open end. The suitcase sections are pivotably connected to one another along a side wall of each section so that the sections can be pivoted away from each other to an open position with the closed ends in the same plane forming an elongated, contiguous, substantially flat ironing board surface. A panel extends outwardly from the side wall of one suitcase section opposite the side wall which is pivotably connected to the other suitcase section and has a substantially flat surface lying in substantially the same plane as the closed ends forming an extension of the ironing board surface. Means are provided for supporting the panel in its outwardly extending position and for retracting the panel through an opening in the side wall when the panel is not in use.

33 Claims, 9 Drawing Sheets

COMBINED SUITCASE AND PORTABLE IRONING BOARD

This invention relates to a combined suitcase and portable ironing board for use by travelers who may wish to iron clothing while in their hotel rooms, for example, and more particularly to an improved combination suitcase and portable ironing board incorporating a retractable extension panel.

BACKGROUND OF THE INVENTION

In the prior art, various types of portable ironing boards are known such as those disclosed in the following patents:

U.S. Pat. No. 2,729,905 to Crozier discloses a portable ironing board and carrying case. The ironing board is mounted to the underneath side of a removable top cover for the case.

U.S. Pat. No. 3,483,954 to Michalski discloses a portable ironing board which can be folded up and stored away inside a carrying case. The ironing board has collapsable legs and brackets for supporting the board during use.

U.S. Pat. No. 3,732,639 to Elder discloses a portable ironing board having a linkage which allows the board to collapse into a carrying case. The case also includes legs which can be removed and stored inside the case when not in use.

There are also known in the art combination suitcase and portable ironing boards such as those disclosed in the following patents:

U.S. Pat. No. 4,412,604 to Bell et al. discloses a multipurpose suitcase having a rectangular cover and body portion wherein a molded V-shaped ironing board is hinged to one end of the body portion and a molded, fork-shaped support is hinged to the other end of the body portion, the latter receiving the the V-shaped ironing board to form a smooth surface rectangular bottom. The molded V-shaped ironing board has a foldable leg with brackets to support the board in place as a contiguous extension of the cover during use. The ironing board is limited in size to the combined length of the V-shaped extension and rectangular cover. Similar suitcase and portable ironing board combinations are disclosed in U.S. Pat. Nos. 3,326,337 (Bell) and 3,512,620 (Bell et al.).

U.S. Pat. No. 3,516,523 to Pemberton, Jr. discloses a combination suitcase and ironing board wherein the case has a top cover and two side walls which are hinged to opposite ends of the top cover. A foldable linkage supports each of the side walls as contiguous extensions of the top cover during use of the case as an ironing board.

The problem with these prior art combined suitcase and portable ironing boards is that they are too complex in construction and, consequently, they are difficult and costly to manufacture. Furthermore, they are awkward and often difficult to use and, in many cases, do not provide enough surface on which to iron certain types of clothing.

It is therefore a principal object of this invention to provide an improved combination suitcase and portable ironing board which is simple in construction and inexpensive to manufacture and which is convenient and ease to use.

Another object of this invention is to provide a combined suitcase and portable ironing board having a retractable extension panel.

SUMMARY OF THE INVENTION

The invention is directed to a combined suitcase and portable ironing board comprising a pair of suitcase sections each including a closed end surrounded by side walls and an open end. The suitcase sections are pivotably connected to one another along a side wall of each section so that the sections can be pivoted away from each other to an open position with the closed ends in the same plane forming an elongated, contiguous, substantially flat surface that serves as an ironing board. The suitcase sections can also be pivoted toward each other to a closed position with their open ends facing each other to form an enclosure. A panel extends outwardly from the side wall of one suitcase section opposite the side wall which is pivotably connected to the other suitcase section and has a substantially flat surface lying in substantially the same plane as the closed ends forming an extension of the ironing board surface. Means are provided for supporting the panel in its outwardly extending position and for retracting the panel through an opening in the side wall when the panel is not in use.

In a preferred embodiment of the invention, the means for supporting the panel is an elongated rod pivotably connected to the underneath side of the panel. The rod has a T-shaped end which fits inside a U-shaped bracket mounted to the suitcase section. The means for retracting the panel includes support members, such as rollers, affixed to the panel and mounted within tracks provided on the inner side of the suitcase section. The tracks guide the panel through the opening and into the interior of the suitcase section.

The combined suitcase and portable ironing board of the invention may also include legs mounted to each suitcase section and extending through the open ends thereof so as to support the sections above the ground. The legs may be mounted within sockets affixed to the inner side of each suitcase section or they may be pivotably mounted for retracting inside each section when not in use. Means may also be provided for locking the legs in place inside each socket or altenatively when pivoted to extend through the open end of each suitcase section. In addition, the legs may be made of two tubular sections one telescoped inside the other and means may be provided for adjusting the length of the tubular sections so that the suitcase sections can be supported a predetermined height above the ground.

DESCRIPTION OF THE PREFERRED EMBODIMENTS

Figure 9:
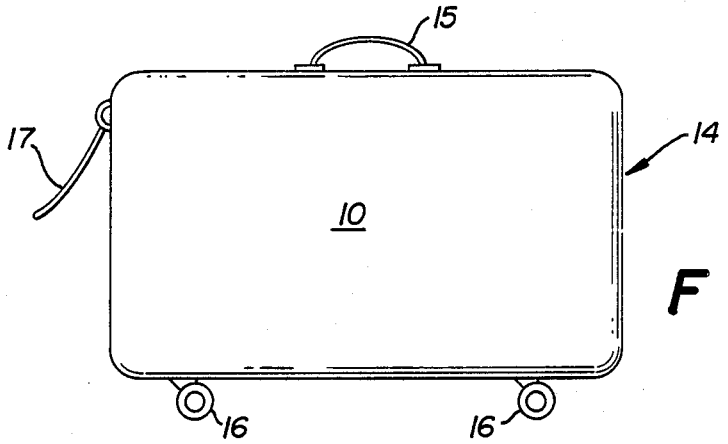
FIG. 9 is a perspective view of the suitcase and portable ironing board of the invention shown in its closed position.

Referring now to the drawing in detail, there is shown in FIGS. 1-9, inclusive, one embodiment of a combined suitcase and portable ironing board according to the invention comprising a pair of rectangular, box-like suitcase sections 10, 11, each having a closed end **10*a*, 11*a*, respectively, surrounded by four side walls 10*b*–10*e* and 11*b*–11*e*, inclusive, and an open end 10*f*, 11*f*, respectively. The suitcase sections 10, 11 are connected to one another by hinges 12 affixed to the corresponding side walls 10*d*, 11*d* so that the two sections may be pivoted outwardly away from each other to an open position lying in a horizontal plane with the two closed ends 10*a*, 11*a* forming an elongated, contiguous, substantially flat ironing board surface indicated generally at 13. The suitcase sections 10, 11 can also be pivoted toward each other to a closed position with their open ends 10*f*, 11*f* facing each other to form an enclosure 14 as shown in FIG. 9. The two suitcase sections 10, 11** may each be molded in one piece from a rigid plastic material or a fiberous composition, such as fiberglass, for example.

In its closed position, the combined suitcase and portable ironing board of the invention can be used to carry the usual travel items, such as shirts, ties, underwear, socks, etc., as well as to store all of the components of the portable ironing board to be hereinafter described. The suitcase enclosure 14 may also include a handle 15 attached to the side wall of one suitcase section 10, wheels 16 mounted onto the opposite side walls forming the bottom of the enclosure, and a pull strap 17.

Figure 4:
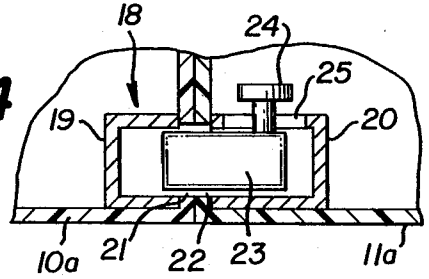
FIG. 4 is a sectional view of a slide bolt for locking the suitcase sections in the open position taken along the lines 4—4 in FIG. 3.

The suitcase sections 10, 11 are provided with a lock 18 for holding the two sections together in the open position with the closed ends **10*a*, 11*a* forming the ironing board surface 13. As best shown in FIG. 4, the lock 18 comprises two housings 19, 20, one of each of which is affixed to the closed end 10*a*, 11*a* of each suitcase section at a location close to the hinged side walls 10*d*, 11*d*. Each housing 19, 20 has an open end which communicates with the other housing through small aligned openings 21, 22 provided in each side wall 10*d*, 11*d*, respectively. An elongated slide bolt 23 with a latch 24 affixed to its rear end is slidably mounted inside one housing 20 with the latch 24 extending outwardly through an elongated slot 25 in its top wall. To lock the two suitcase sections 10, 11 together when in their open position, the latch 24 is moved toward the hinged side wall 11*d* so that the front end of the slide bolt 23 passes through the two aligned openings 21, 22 and into the opposite housing 19. The suitcase sections may be unlocked again to close the suitcase by simply moving the latch 24** in the opposite direction.

Figure 1:
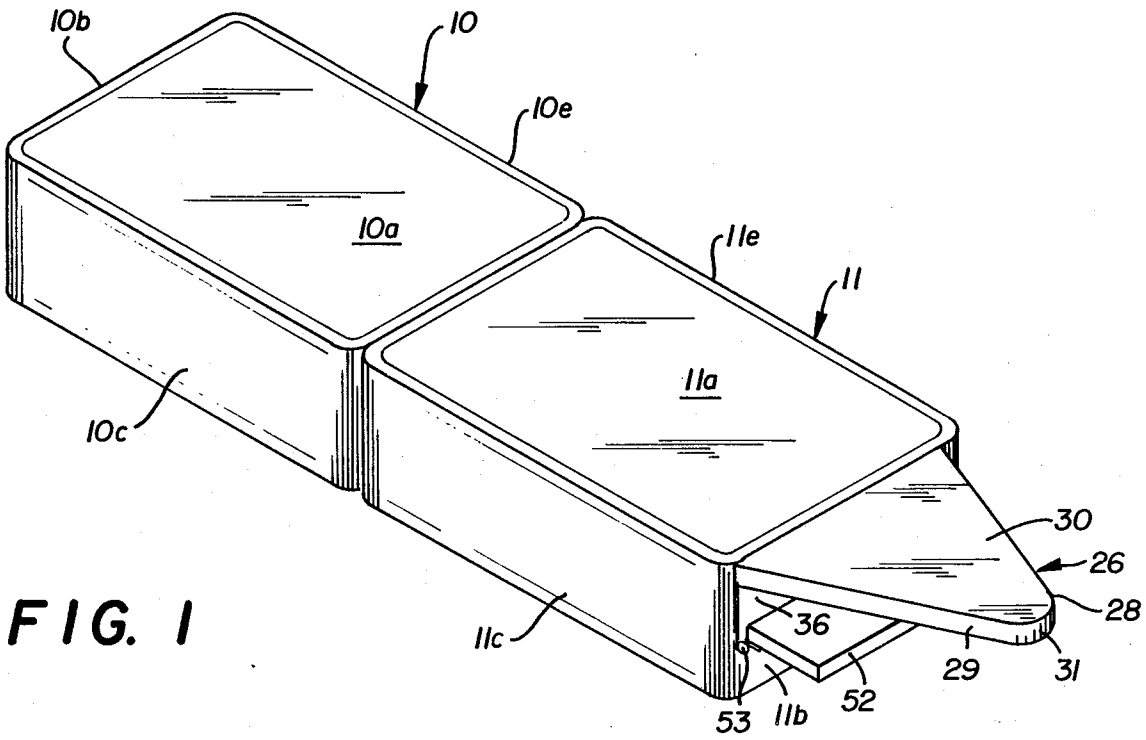
FIG. 1 is a perspective view showing a combined suitcase and portable ironing board according to the invention in its open position with the retractable panel fully extended outwardly from the side wall of one suitcase section.
Figure 3:
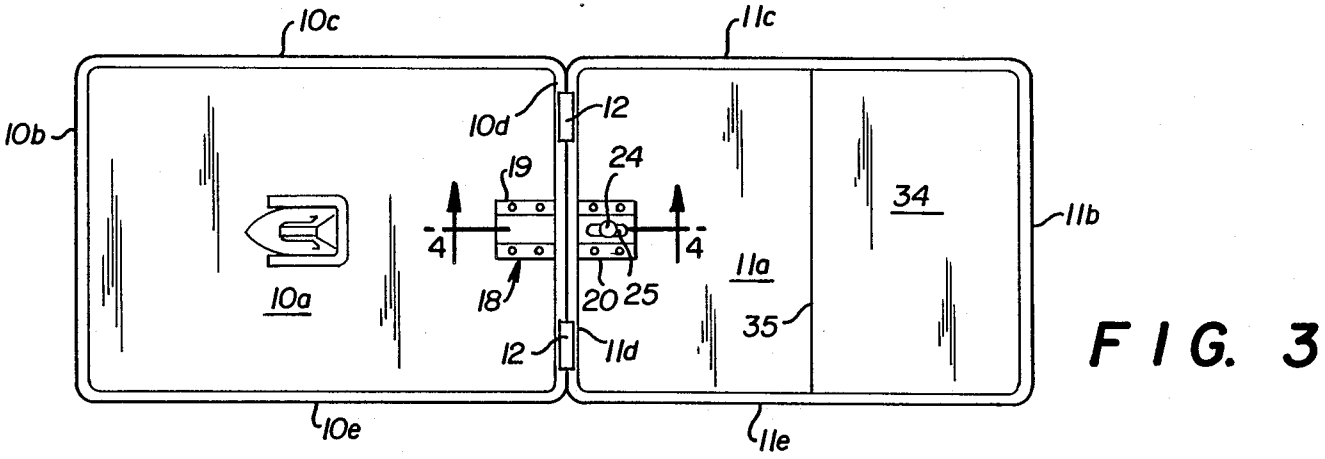
FIG. 3 is a bottom plan view of the combined suitcase and portable ironing board shown in both FIGS. 1 and 2.
Figure 2:
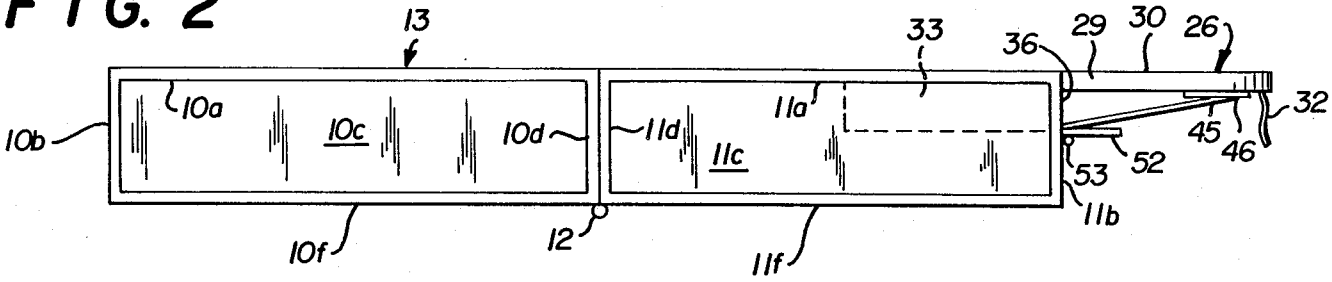
FIG. 2 is a side elevational view of the combined suitcase and portable ironing board shown in FIG. 1.
Figure 5:
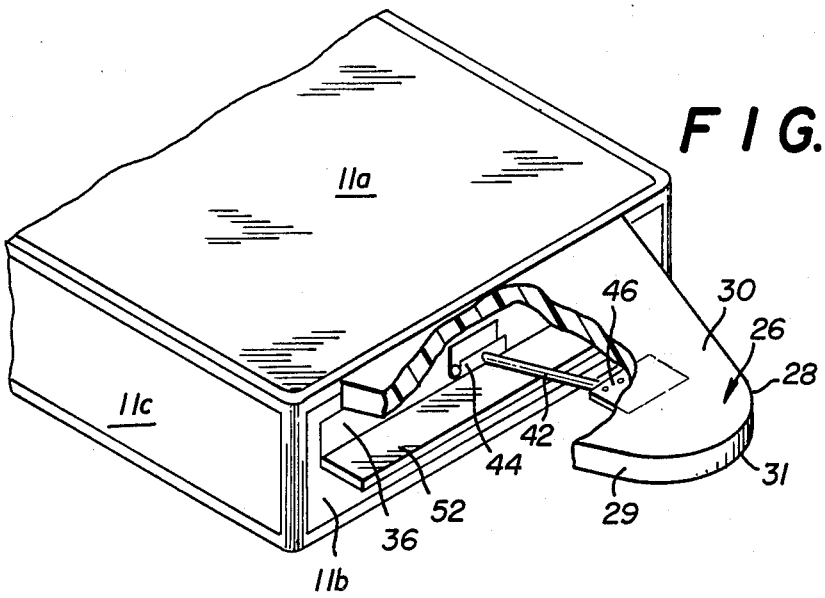
FIG. 5 is an enlarged fragmentary perspective view of the front end of the conbined suitcase and portable ironing board shown in FIGS. 1 and 2 with part of the retractable panel being broken away to show details of construction.

An ironing board nose panel 26 protrudes outwardly from the side wall **11*b* of the suitcase section 11 as best shown in FIGS. 1, 2 and 5. The panel 26 is triangular in shape having a base 27, two sides 28, 29 and a flat top surface 30. The outer apex end 31 of the panel 26** is rounded to form a smooth point for the ironing board.

Figure 7:
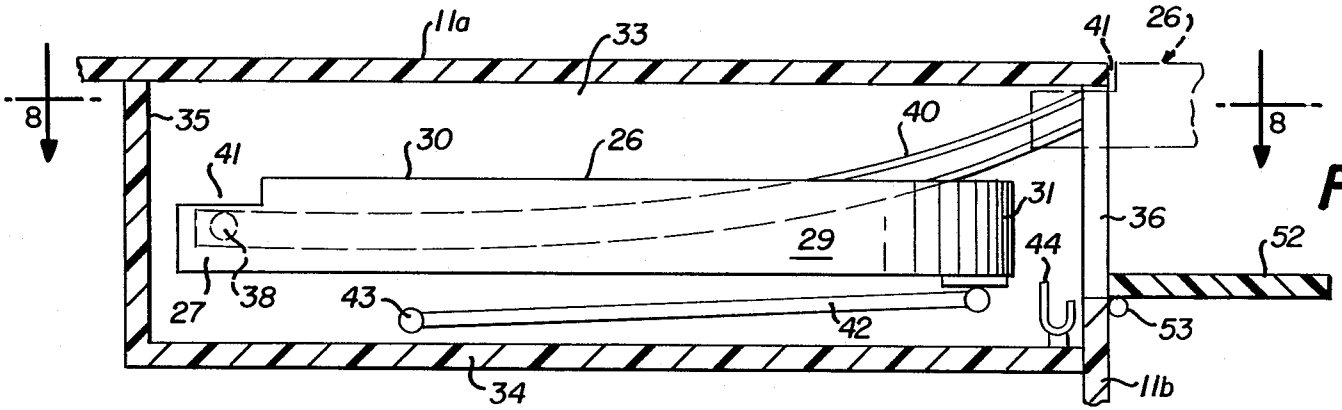
FIG. 7 is an enlarged fragmentary elevational view of the combined suitcase and portable ironing board illustrated in FIGS. 1 and 2 showing the extension panel fully retracted within an elongated, narrow compartment formed inside one of the suitcase sections.
Figure 8:
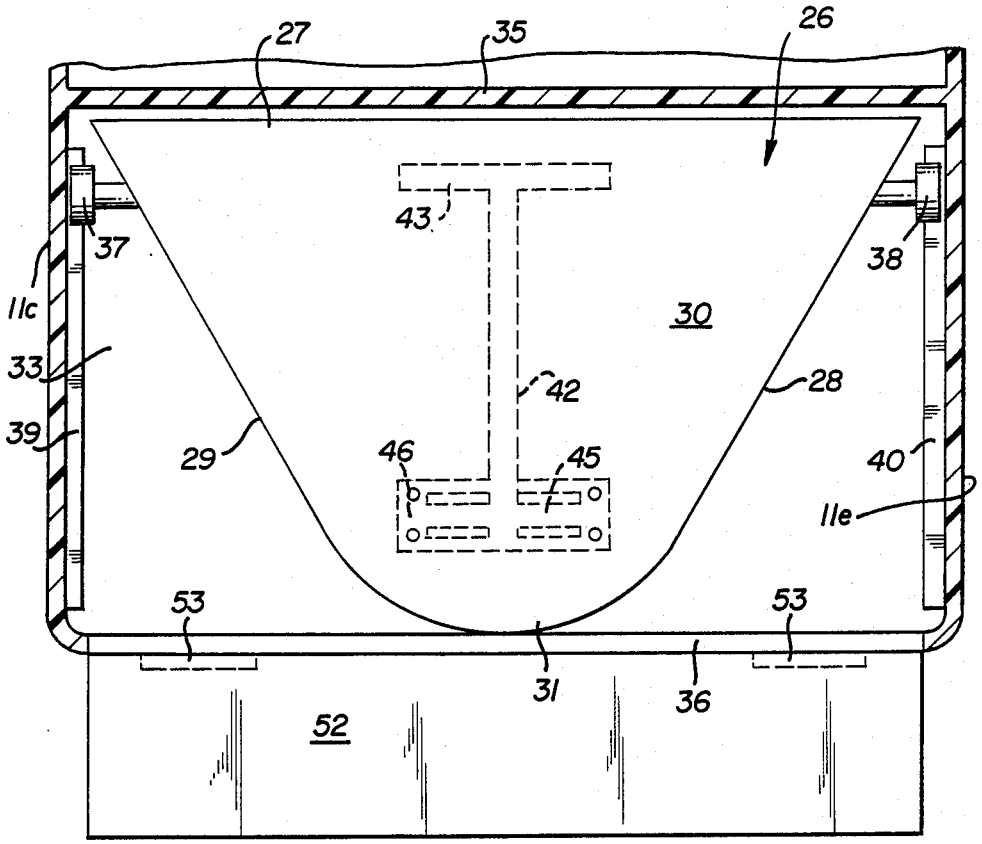
FIG. 8 is an enlarged top plan view of the panel and compartment taken along the lines 8—8 in FIG. 7.

The nose panel 26 is retractable into the interior of the suitcase section 11 and can be stored when not in use in its own separate compartment 33 as shown in FIGS. 7 and 8. The compartment 33 is formed by two partition members 34, 35, one of which partitions 34 is parallel to the closed end **11*a* extending laterally across the full width of the suitcase section 11 and longitudinally a distance equal to about one-half of the length thereof. The other partition 35 extends laterally between the closed end 11*a* and the innermost end of the partition 34 and serves as the rear wall of the compartment 33. The dimensions of the compartment 33** should be kept to a minimum so as to occupy as little space as possible inside the suitcase.

The panel 26 retracts into the compartment 33 through an elongated, narrow slot 36 provided in the side wall **11*b* of the suitcase section 11. The slot 36 extends laterally across the side wall 11*b* at a point just below the top surface of the closed end 11*a* and is of a sufficient size to accomodate the base 27 of the nose panel 26**.

Mounted onto each side 28, 29 of the nose panel 26 at a point close to the base 27 is one of a pair of rollers 37, 38, respectively. The rollers 37, 38 are each secured for travel along one of two tracks 39, 40, respectively. The two tracks are mounted to the opposite side walls 11c, 11e inside the compartment 33. The tracks 39, 40 extend longitudinally along the full length of the narrow compartment 33 and are bent or curved upwardly from the rearward to the forward end of each track as shown in FIG. 7, the forward end of each track being located just inside the top of the slot 36. With this construction, the nose panel 26 may be easily pulled forward along the tracks 39, 40 and through the slot 36 to withdraw the panel from inside the compartment 33 while at the same time placing the the panel 26 in substantially the same plane as the two closed ends 10a, 11a forming the ironing board surface 13. A pull strap 32 may be attached underneath the point 31 of the nose panel 26 to facilitate withdrawing the panel. It will be noted that a small notch or cut-out 41 is provided along the base 27 on top of panel 26 to accomodate the top edge of the slot 36 when the panel is fully withdrawn and thus allow its top surface 30 to lie flush with the ironing board surface 13.

Figure 6:
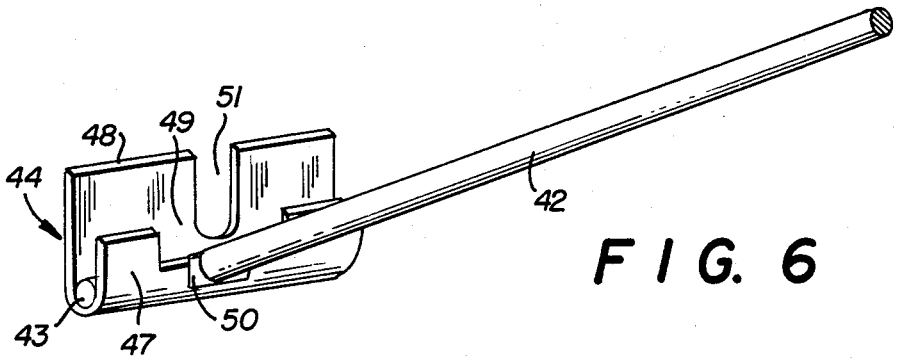
FIG. 6 is an enlarged perspective view of the support rod and bracket for supporting the retractable panel.

An elongated support rod 42 is pivotably mounted to the underneath side of the nose panel 26. The rod 42 has a T-shaped outer end formed by a cross-bar 43 which is adapted to be removably atached to a U-shaped bracket 44 as shown in FIG. 6. The opposite end of the rod 42 has a smaller cross bar 45 which is rotatably mounted inside a hinge bracket 46 (FIG. 8) secured to the underneath side of the panel 26.

The U-shaped bracket 44 is mounted to the partition 34 forming the narrow compartment 33 at a point just inside the slot 36 as shown in FIGS. 5 and 7. The front wall 47 of the bracket 44 is shorter than the back wall 48 and has a cut-out 49 which is formed with a notch 50 to accomadate the elongated rod 42 when it is attached to the bracket 44. The back wall 48 is also provided with a notch 51 at the center thereof which enables the rod 42 to pass through and beyond the bracket 44 when the nose panel 26 is retracted into the compartment 33.

It will be seen that once the nose panel 26 has been withdrawn from inside the suitcase section 11 in the manner as described hereinabove, the panel can be secured in place by simply placing the T-shaped end of the support rod 42 into the bracket 44. The length of the rod 44 is chosen such that the nose panel 26 will always be held in substantial alignment with the ironing board surface 13 when the rod 42 is attached to the bracket 44. To withdraw the nose panel 26, the rod 42 is simply raised upwardly to remove the cross bar 43 from the bracket 44. The rod 42 is then placed inside the center notch 51 which guides the rod and panel back into the interior of the compartment 33. An elongated cover 52 may be provided to close the slot 36 once the panel 26 has been completely withdrawn. The cover 52 is preferably attached to the side wall 11b just below the slot 36 by one or more spring-loaded hinges 53 (FIGS. 7 and 8).

The combined suitcase and ironing board illustrated in FIGS. 1–9, inclusive, may be conveniently placed in its open position on top of a table, dresser or other piece of furniture, preferably at about waist height, during its use as a portable ironing board. Alternatively, the combined suitcase and portable ironing board can be supported by a plurality of adjustable legs extending through the open ends of each suitcase section 10, 11 as shown in FIGS. 10–17, inclusive.

Figure 12:
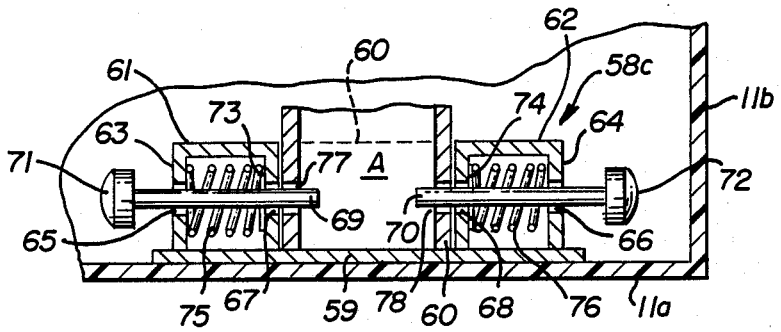
FIG. 12 is a sectional view of one of the sockets for mounting the legs taken along the lines 12—12 in FIG. 10.
Figure 10:
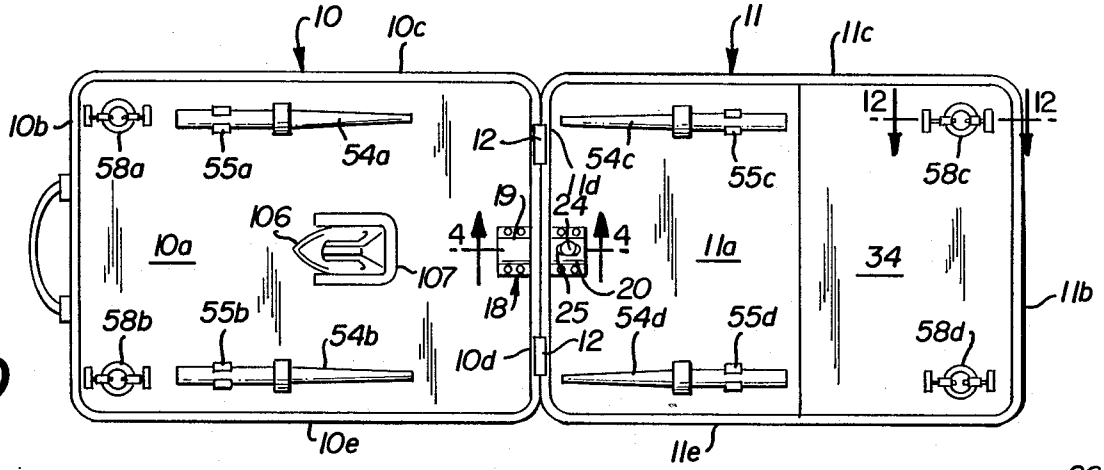
FIG. 10 is a bottom plan view of another embodiment of a combined suitcase and portable ironing board according to the invention incorporating legs for supporting the suitcase sections in the open position above the ground.
Figure 11:
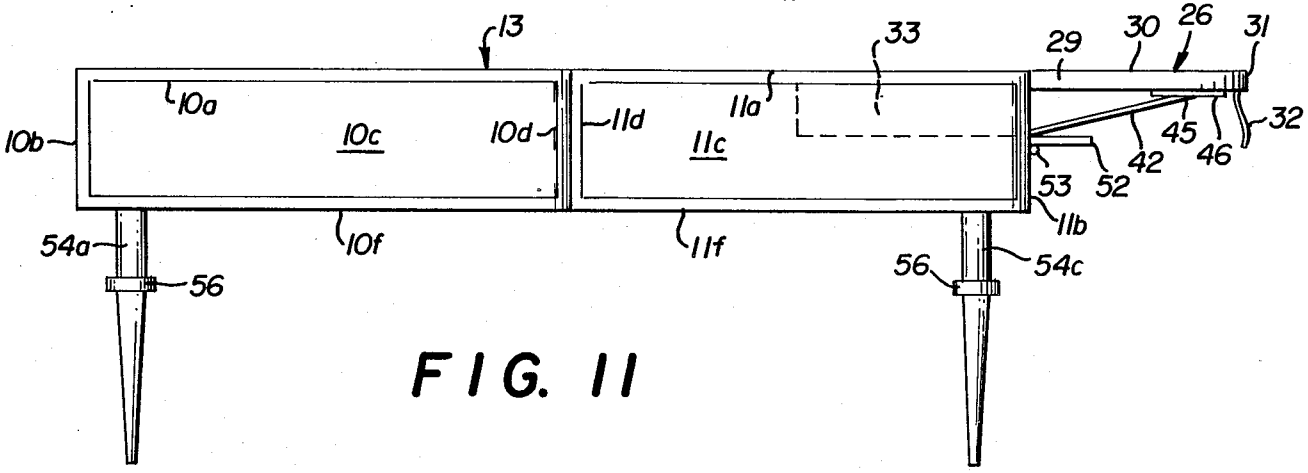
FIG. 11 is a side elevational view of the combined suitcase and portable ironing board shown in FIG. 10 with the legs mounted within sockets and extending through the open ends of the suitcase sections.

In the embodiment of the combined suitcase and portable ironing board illustrated in FIGS. 10–12, for example, four legs 54a–54d, inclusive, are stored inside the suitcase enclosure for use in the portable ironing board, two of the legs 54a, 54b being located in the suitcase section 10 and the other two legs 54c, 54d being located in the suitcase section 11. The legs are each held in place by one of four flexible U-shaped clips 55a–55d, two of the clips 55a, 55b being secured to the closed end 10a and the other two clips 55c, 55d being secured to the closed end 11a.

Figure 17:
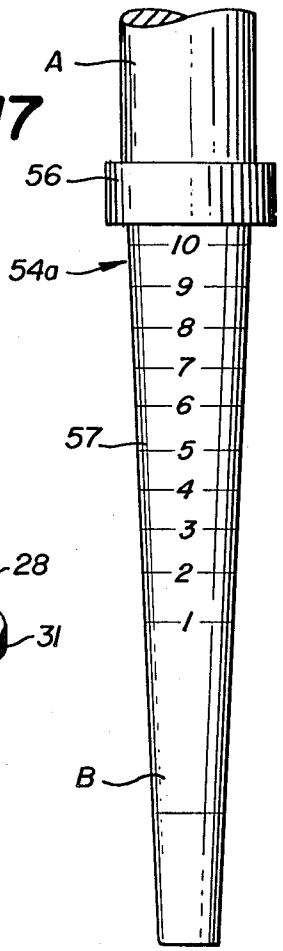
FIG. 17 is a side elevational view of the tubular telescoping leg sections with indicia and means for adjusting the length of the legs.

Each of the legs 54a–54d is constructed with two separate tubular sections A and B as best shown in FIG. 17. The upper section A of each leg is of a fixed diameter while the lower section B tapers from a larger diameter end to a smaller diameter end, the larger diameter end telescoping inside the upper section A.

A compression collar 56 is mounted to the lower end of the tubular section A which when rotated in one direction applies sufficient pressure around the tapered lower section B to lock it in place at a predetermined length. The lower section B of each leg can be loosened by simply rotating the collar 56 in an opposite direction. Compression collars of the type described are conventional and readily available in the industry.

Indicia such as spaced apart horizontal lines 57 with numerals representing inches, etc. may be provided on the surface of the lower section B to assist in setting the legs to a desired length. Each leg is independently adjustable so that the portable ironing board can be supported in a level position at about waist height above the ground.

When it is desired to use the portable ironing board according to the invention, the legs 54a–54d, inclusive, are each pulled upwardly away from the closed ends 10a, 11a so as to release the legs from the respective storage clips 55a–55d. The upper tubular section A of each leg is then mounted within one of four separate sockets 58a–58d, inclusive, provided on the inside of each suitcase sections 10, 11, two of the sockets 58a, 58b being secured to the closed end 10a and the other two sockets 58c, 58d being secured to the partition 34 forming the compartment 33 in the suitcase section 11. The sockets are each located within or close to one of the four corners defined by each opposite side wall 10b, 11b and its two adjointing side walls 10c, 10e and 11c, 11e, respectively. In this manner, when the portable ironing board is turned upright and placed on the ground as shown in FIG. 11, the two suitcase sections 10 and 11 defining the elongated ironing board surface 13 are supported at each of the four corners by one of the four legs 54a–54d, respectively.

FIG. 12 shows in enlarged detail the construction of one of the sockets 58a equipped with locking means for locking each leg in place during use of the portable ironing board. The socket has a horizontal base 59 to which is mounted a cylindrical section 60 having an inner diameter which is slightly larger than the outer diameter of the upper section A of each leg. Two small enclosures 61, 62 are provided adjacent to the side wall of the cylindrical section 60 in diametrically opposed relation, each enclosure having an outer wall 63, 64 provided with an opening 65, 66, respectively, which is in alignment with a corresponding opening 67, 68 in the side wall of the cylindrical section 60. One of two pins 69, 70 passes through each enclosure 61, 62 via the openings 65, 66 in the respective side walls 63, 64 and their aligned openings 67, 68 in the cylindrical section 60. Each pin 69, 70 is provided with a head 71, 72, respectively, for ease in grasping the pin and is of a sufficient length to pass completely into the interior of the cylindrical section 60. A retainer disc 73, 74 is secured to each pin 69, 70, respectively, inside each enclosure 61, 62 and abuts against the side wall of the cylindrical section 60 limiting movement of each pin. A coil spring 75, 76 is placed around each pin 69, 70 inside of each enclosure and biases the pin in the direction of the cylindrical section 60. The sockets can be mounted by glueing or otherwise securing the horizontal base 59 to either the closed end 10*a* or the partition 34.

The upper tubular section A of each leg 54*a*–54*d* is provided with a pair of diametrically opposed openings 77, 78 which aligned with the respective pins 69, 70 when each section is inserted into one of the sockets 55*a*–55*d*. Typically, during assembly, the pins are first pulled outwardly away from the socket to allow insertion of the upper tubular leg section A and then released under the pressure of the coil springs 75, 76. The leg section A may then be rotated inside the socket until the pins 69, 70 register with the openings 77, 78 to lock the leg in place. To remove the legs, the pins 69, 70 are simply pulled outwardly against the coil springs 75, 76 to allow the tubular section A to be withdrawn.

FIGS. 13–16, inclusive, show another embodiment of a combined suitcase and ironing board according to the invention wherein pairs of adjustable legs 79*a*, 79*b* and 79*c*, 79*d* are joined together and pivotably mounted inside the two suitcase sections 10, 11. Each pair of legs is joined together by a laterally extending tubular brace 80*a*, 80*b*, respectively, which is formed integrally with the upper tubular section A of each leg. The legs are otherwise identical in construction to those described hereinabove and shown in FIG. 17. The tubular support 80*a* for the pair of legs 79*a*, 79*b* is pivotable mounted in place by a pair of U-shaped brackets 81*a*, 81*b* glued or riveted to the closed end 10*a* in close proximity to the side wall 10*b* of the suitcase section 10. In a similar fashion, the tubular brace 80*b* for the pair of legs 79*c*, 79*d* is pivotably mounted in place by a pair of U-shaped brackets 81*c*, 81*d* glued or rivoted to the partition 34 in close proximity to the side wall 11*b* of the suitcase section 11. It will be noted that in the case of the legs 79*c*, 79*d* in the suitcase section 11, the two lower tubular sections B of the legs are stored separately from the upper tubular sections A since the latter are mounted to the partition 34 which is at a different level inside the suitcase section 11. The lower sections B of each leg 79*c*, 79*d* are attached to the closed end 11*a* by the same type of flexible clips 82*a*, 82*b*.

Figure 15:
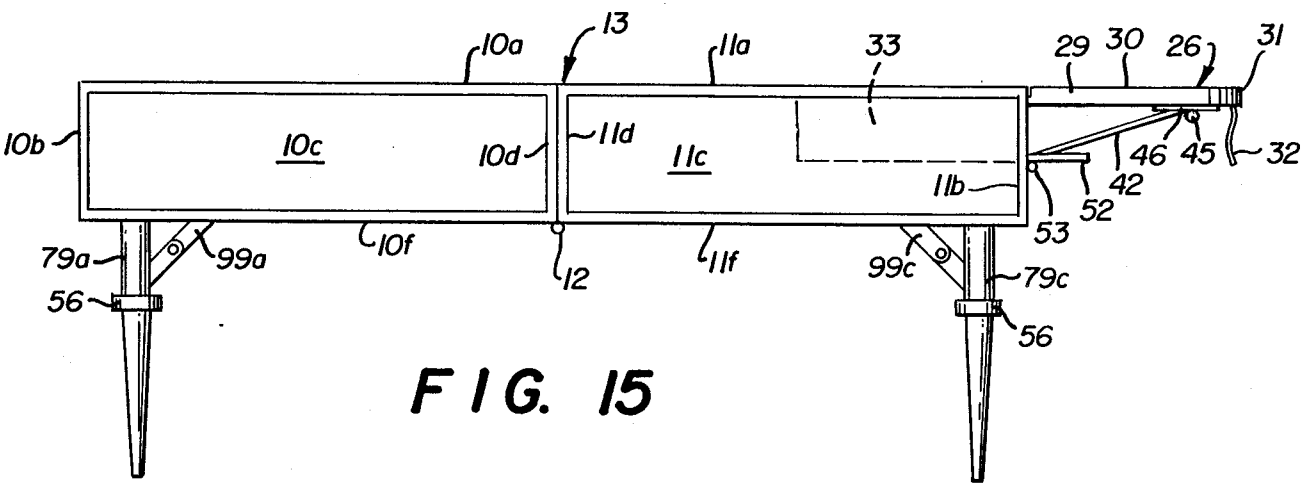
FIG. 15 is a side elevational view of the combined suitcase and portable ironing board shown in FIG. 13 with the legs fully extended through the open ends of the suitcase sections.
Figure 16:
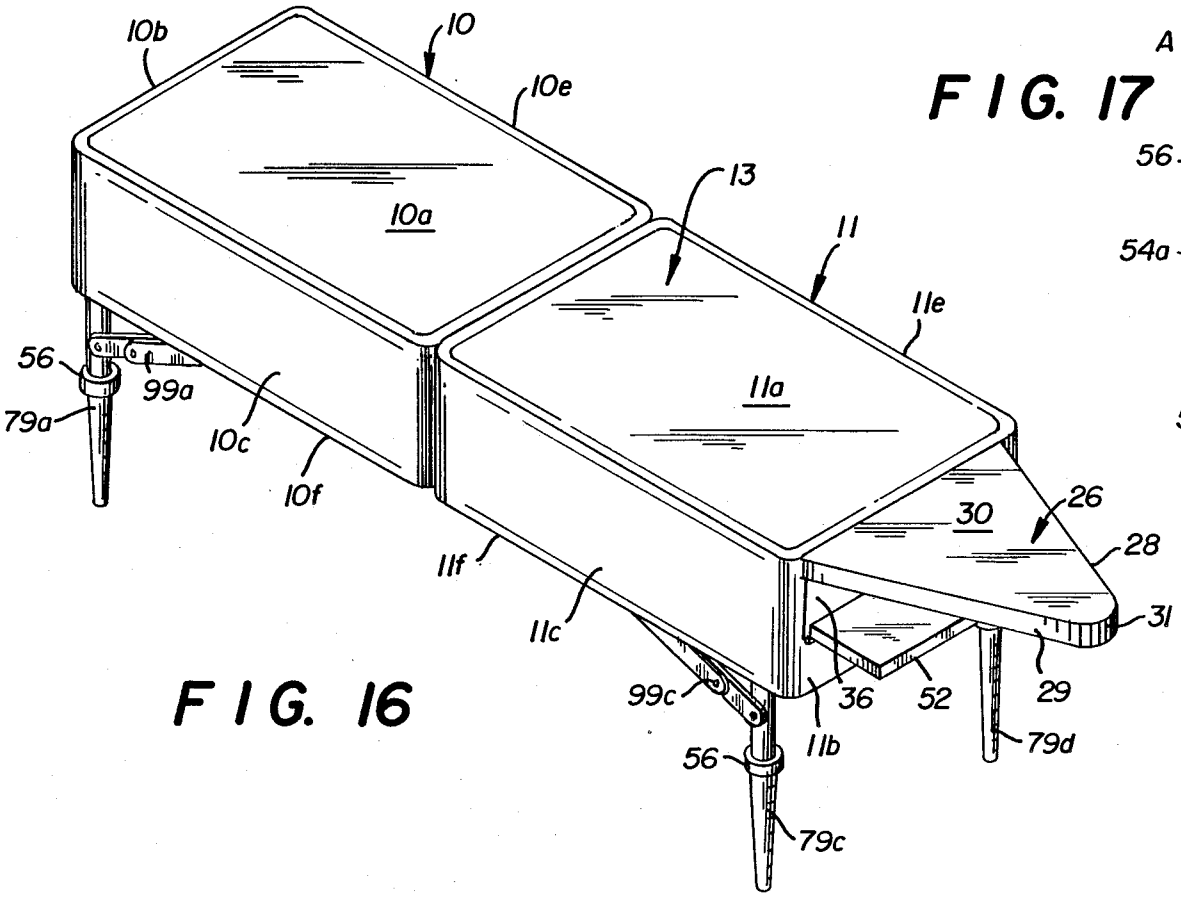
FIG. 16 is a perspective view of the combined suitcase and portable ironing board shown in FIGS. 14 and 15 in the open position with the retractable panel fully extended from the side wall of one suitcase section.

When it is desired to employ the portable ironing board according to this embodiment of the invention, the two lower sections B of the legs 79*c*, 79*d* are removed and telescoped into the upper sections A to complete the structure of each leg. The pairs of legs 79*a*, 79*b* and 79*c*, 79*d* are then pivoted outwardly to extend beyond the open ends 10*f*, 11*f* into a position generally normal to the closed ends 10*a*, 11*a* and are secured in place by locks 83*a*, 83*b*, respectively. The two suitcase sections 10, 11 are then turned upright and placed on the ground for use as an ironing board as shown in FIGS. 15 and 16.

Figure 14:
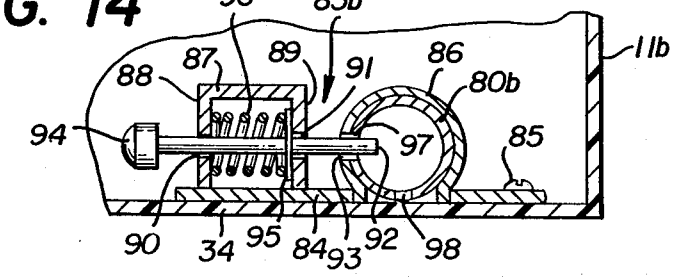
FIG. 14 is a side elevational view of a spring-loaded lock for locking the retractable legs in place taken along the lines 14—14 in FIG. 13.

FIG. 14 shows the construction of one of the locks 83*b* which is mounted around the central portion of the tubular brace 80*b* for the pair of legs 79*c*, 79*d*. The other lock 83*a* is of identical construction and is mounted around the central portion of the tubular support 80*a* for the pair of legs 79*a*, 79*b*.

The lock 83*b* has a base 84 which is secured to the partition 34 as by rivets 85 and a cylindrical housing 86 which fits loosely around the tubular brace 80*b* allowing the latter to rotate freely inside the lock. Also mounted to the base 84 adjacent the cylindrical housing 86 is an enclosure 87 having two side walls 88, 89 provided with openings 90, 91, respectively. An elongated pin 92 passes through the enclosure 87 via the openings 90, 91 and through an aligned opening 93 in the cylindrical housing 86. The pin 92 is provided with a head 94 for ease in grasping the pin and is of sufficient length to pass completely into the interior of the cylindrical housing 86. A retainer disc 95 is secured to the pin 92 inside the enclosure 87 and abuts against the side wall 89 limiting movement of the pin. A coil spring 96 is placed around the pin 92 between the side wall 88 and the retainer disc 95 and biases the pin in the direction of the cylindrical housing 86.

Figure 13:
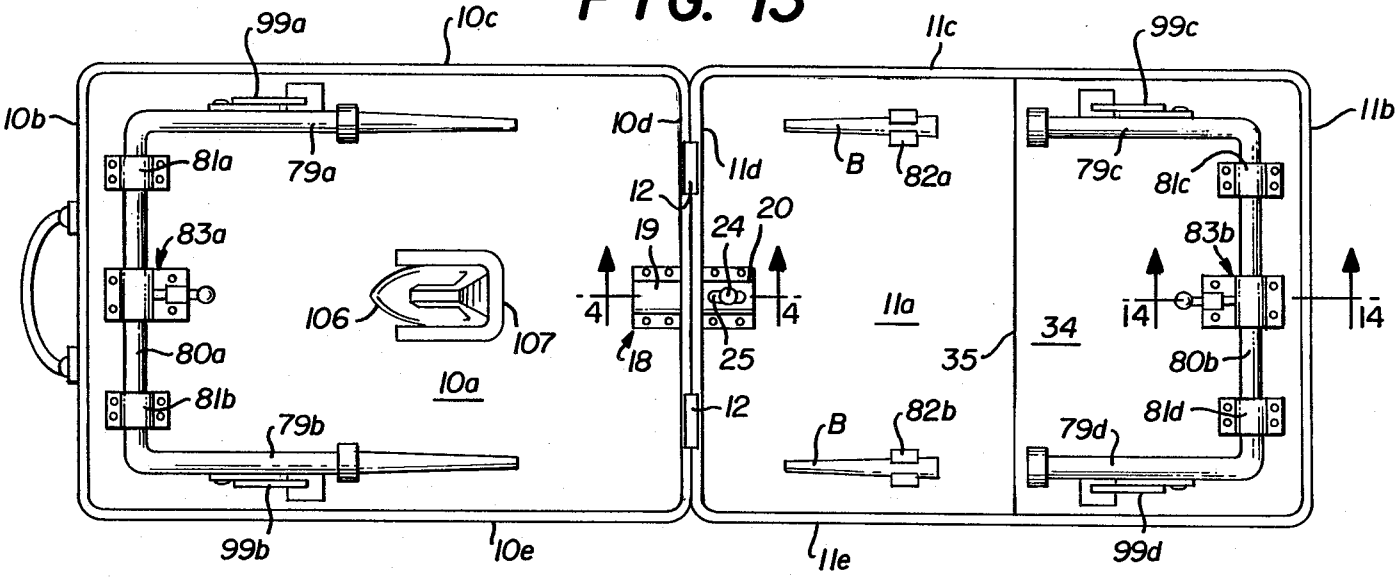
FIG. 13 is a bottom plan view of still another embodiment of a combined suitcase and portable ironing board according to the invention incorporating retractable legs for supporting the suitcase sections.

The tubular brace 80*b* has an openings 97 in its side wall which aligns with the opening 93 in the cylindrical housing 86 when the legs 79*c*, 79*d* are stored in place inside the suitcase section 11 as shown in FIG. 13. The tubular brace 80*b* has another opening 98 located about 90 degrees from the opening 97 which aligns with the opening 93 when the legs 79*c*, 79*d* are pivoted to their outwardly extending position as shown in FIGS. 15 and 16. In either position, the legs are locked in place by the pin 92 which is biased to pass through the aligned openings by the coil spring 96. To unlock the legs, the pin 92 is withdrawn from the cylindrical housing 86 by pulling the head 94 in a direction away from the enclosure 87. When the legs are pivoted to a new position, the head 94 is released to allow the pin 92 to move back toward the cylindrical housing 86 under the force of the coil spring 96 whereupon the pin again locks the legs in place as soon as the other of the two openings 97, 98 aligns itself with the opening 93 in the cylindrical housing 86.

The legs 79*a*–79*d* may be provided with additional support in the form of foldable brackets 99*a*–99*d*, respectively, when pivoted to the outwardly extending position as shown in FIGS. 15 and 16. The foldable brackets attach between the upper section A of each leg and the closed end 10*a* in the case of the legs 79*a*, 79*b* and the partition 34 in the case of the legs 79*c*, 79*d*. The brackets are the same type as commonly used to support the legs of card tables and the like.

Figure 18:
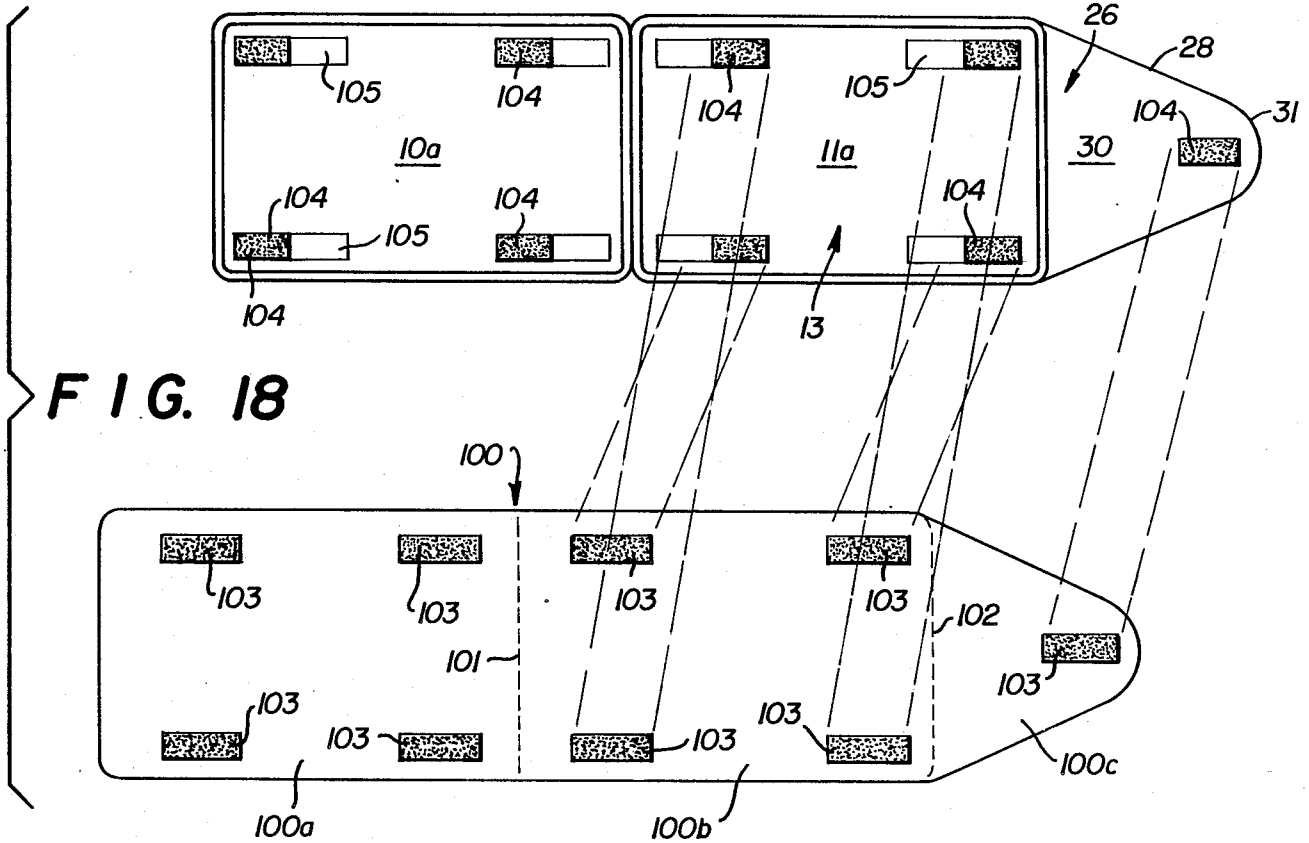
FIG. 18 is an exploded top plan view of a combined suitcase and portable ironing board according to the invention in its open position and a foldable ironing board pad with Velcro strips for attaching the pad to the ironing board surface.

A foldable ironing board pad 100 may be provided for use with the portable ironing board according to the invention as shown in FIG. 18. In this view of the drawing, the pad 100 is shown with its underneath side facing upward inorder to better illustrate the details of its construction. The pad 100 is contructed from three separate pieces of soft, flat, thin, flexible, foam material. The first two pieces 100*a*, 100*b* are of substantially the same size and rectangular shape as the closed ends 10*a*, 11*a*, respectively, and thus cover the whole ironing board surface 13. The third piece 100*c* is of the same size and triangular shape as the nose panel 26 and covers the whole panel when withdrawn from the inside the suitcase section 11. The two rectangular pieces of foam 100*a*, 100*b* are hingeably joined together by a flexible adhesive tape or the like (not shown) to form a fold line 101. In a similar fashion, the third triangular piece of foam material 100*c* is hingeable joined to the second piece of foam material 100*b* by the same type of tape to form a fold line 102. Thus, the whole ironing board pad 100 can be folded twice along its length inorder to reduce its size and carried separately or stored inside the suitcase enclosure 14. In the latter case, the width of the pad 100 should be slightly less than the width of each suitcase section 10, 11 inorder to allow the pad to fit easily therein.

The pad 100 may be secured to the suitcase sections 10, 11 by a series of Velcro strips 103 provided on the underneath side of each piece of foam material 100a–100c, inclusive, as shown in FIG. 18. The strips 103 are placed at predetermined locations so that when the pad is turned rightside up and positioned on top of the surface 13, each strip 103 will join with one of another series of Velcro strips 104 secured to the closed ends 10a, 10b and the nose panel 26 in the manner depicted by the phantom lines in FIG. 18. The Velcro strips 104 are each preferably provided with covers 105 also of the same Velcro material which can be folded over on top of the strips 104 to protect them from damage by objects outside of the suitcase enclosure 14.

A small portable clothes iron 106 may be stored inside one of the suitcase sections 10 as shown in FIGS. 10 and 13. The portable iron 106 may be carried within a generally U-shaped, molded plastic holder 107 secured to the closed end 10a as by gluing or rivets, for example.

From the foregoing, it will be seen that the invention provides a combined suitcase and portable ironing board which is compact, easy to manufacture, simple and convenient to use. The nose panel is retractable into one suitcase section and occupies only a limited space leaving the rest of the suitcase enclosure for storing cloths and other items for travel.

Various modifications of the invention are possible. For example, the retracting means for the extension panel may include a pair of sliding pins in place of the rollers mounted within the tracks. Other modifications will of course readily occur to those skilled in ths art.

What is claimed is:

1. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position; and means for retracting said panel through an opening in said opposite side wall when said panel is not in use.

2. A combined suitcase and portable ironing board according to claim 1, further including legs attached to said suitcase sections and extending through said open ends so as to support said suitcase sections above the ground.

3. A combined suitcase and portable ironing board according to claim 1, wherein said attaching means comprises flexible chips.

4. A combined suitcase and portable ironing board according to claim 3, wherein each of said legs comprises two tubular sections one telescoping inside the other and means for adjusting the length of said tubular sections so that said suitcase sections can be supported at a predetermined height above the ground.

5. A combined suitcase and portable ironing board according to claim 4, wherein said leg adjusting means comprises a compression collar.

6. A combined suitcase and portable ironing board according to claim 4, further including indicia means on said telescoping legs to aid in adjusting the length of said tubular sections.

7. A combined suitcase and portable ironing board according to claim 2, further including means for pivotably mounting said legs onto the inner side of said closed ends and means for locking said legs in place when extending through said open ends of said suitcase sections.

8. A combined suitcase and portable ironing board according to claim 7, wherein each of said legs comprises two tubular sections one telescoping inside the other and means for adjusting the length of said tubular sections so that said suitcase sections can be supported at a predetermined height above the ground.

9. A combined suitcase and portable ironing board according to claim 8, wherein said leg adjusting means comprises a compression collar.

10. A combined suitcase and portable ironing board according to claim 7, further including foldable bracket means for each leg, said foldable bracket means being connected between one of said suitcase sections and said leg.

11. A combined suitcase and portable ironing board according to claim 1, further including means for locking said pair of suitcase sections together when pivoted to said open position.

12. A combined suitcase and portable ironing board according to claim 1, further including a holder affixed to the inner side of one of said closed ends of said suitcase sections for receiving and holding a portable iron.

13. A combined suitcase and portable ironing board according to claim 1, further including an elongated ironing board pad which is foldable into sections one on top of the other so as to fit inside said suitcase enclosure.

14. A combined suitcase and portable ironing board according to claim 13, further including means for detachably mounting said pad onto the other side of said closed ends of said suitcase sections forming said ironing board surface and said panel.

15. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position;

means for retracting said panel through an opening in said opposite side wall when said panel is not in use;

a plurality of legs attached to said suitcase sections and extending through said open ends for supporting said suitcase sections above the ground; and means for locking said pair of suitcase sections together when pivoted to said open position.

16. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position; and means for retracting said panel through an opening in said opposite side wall when said panel is not in use;

a cover including means for pivotable connection to said opposite side wall and adapted to close said opening when said panel is retracted;

a plurality of legs attached to said suitcase sections and extending through said open ends for supporting said suitcase sections above the ground, each of said legs comprising two tubular sections one telescoping inside the other;

means for adjusting the length of said tubular sections so that said suitcase sections can be supported at a predetermined height above the ground; and means for locking said pair of suitcase sections together when pivoted to said open position.

17. A combined suitcase and portable ironing board according to claim 16, further including means for biasing said cover toward its closed position.

18. A combined suitcase and portable ironing board according to claim 17, further including an elongated ironing board pad which is foldable into sections one on top of the other so as to fit inside said suitcase enclosure.

19. A combined suitcase and portable ironing board according to claim 18, further including a holder affixed to the inner side of one of said closed ends of said suitcase sections for receiving and holding a portable iron.

20. A combined suitcase and portable ironing board according to claim 19, further including indicia means on said telescoping legs to aid in adjusting the length of said tubular sections.

21. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position comprising an elongated rod with a T-shaped end including means for pivotable connection to the underneath side of said panel and a U-shaped bracket mounted to said one suitcase section, said bracket including means for receiving the T-shaped end of said rod in locking engagement therewith; and means for retracting said panel through an opening in said opposite side wall when said panel is not in use.

22. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position; and means for retracting said panel through an opening in said opposite side wall comprising support members affixed to said panel and tracks mounted to the inner side of said one suitcase section, said support members being mounted within and guided by said tracks for moving said panel through said opening and into the interior of said one suitcase section.

23. A combined suitcase and portable ironing board according to claim 22, wherein said support members are rollers affixed to said panel and mounted within said tracks.

24. A combined suitcase and portable ironing board according to claim 23, wherein said opening in said opposite side wall is located in close proximity to said contiguous flat ironing board surface and wherein said tracks are curved upwardly toward said opening so as to raise said panel to the level of said flat surface when moved outwardly to its extended position from inside said one suitcase section.

25. A combined suitcase and portable ironing board according to claim 24, wherein a rearward portion of said panel remains within said opening in said opposite side wall when said panel is fully extended and wherein said rearward portion of said panel is cut away to allow the top surface of said panel to lie flush with said flat ironing board surface.

26. A combined suitcase and portable ironing board according to claim 22, further including a cover including means for pivotable connection to said opposite side wall and adapted to close said opening when said panel is retracted.

27. A combined suitcase and portable ironing board according to claim 26, further including means for biasing said cover toward its closed position.

28. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, continguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming and extension of said ironing board surface;

means for supporting said panel in said outwardly extending position;

means for retracting said panel through an opening in said opposite side wall when said panel is not in use;

a plurality of legs attached to said suitcase sections and extending through said open ends so as to support said for receiving the ends of each of said legs;

means for locking said legs in place within said sockets; and means for removably attaching said legs onto the inner side of said closed ends when said legs are not in use.

29. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position;

means for retracting said panel through an opening in said opposite side wall when said panel is not in use;

a plurality of legs attached to said suitcase sections and extending through said open ends so as to support said suitcase sections above the ground;

sockets affixed to the inner side of said closed ends for receiving the ends of each of said legs;

means for locking said legs in place within said sockets; and means for removably attaching said legs onto the inner side of said closed ends when said legs are not in use.

30. A combined suitcase and portable ironing board according to claim 29, wherein said attaching means comprises flexible clips.

31. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position;

means for retracting said panel through an opening in said opposite side wall;

a plurality of legs attached to said suitcase sections and extending through said open ends so as to support said suitcase sections above the ground, said legs being joined together by a laterally extending support member;

means for pivotably mounting said legs onto the inner side of said closed ends; and means for locking said legs in place when extending through said open ends of said suitcase sections comprising a housing affixed to the inner side of one of said closed ends adjacent to said support member, an elongated pin movably mounted within said housing and adapted t slide through an opening in said support member and spring means for biasing said pin in the direction of said support member.

32. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with aid closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position;

means for retracting said panel through an opening in said opposite side wall; and means for locking said pair of suitcase sections together when pivoted to said open position comprising a housing affixed to one of sections adjacent to the side wall which is pivotably connected to the side wall of the other section and a bolt movably mounted inside said housing and adapted to slide through aligned openings in both of said side walls of said sections.

33. A combined suitcase and portable ironing board comprising, in combination:

a pair of suitcase sections each including a closed end surrounded by side walls and an open end, said sections including means for pivotable connection to one another along a side wall of each section so that said sections can be pivoted away from each other to an open position with said closed ends in the same plane forming an elongated, contiguous, substantially flat ironing board surface and said sections can be pivoted toward each other to a closed position with their open ends facing each other to form an enclosure;

a panel extending outwardly from the side wall of one suitcase section opposite the side wall which is pivotably connected to the other suitcase section and having a substantially flat surface lying in substantially the same plane as said closed ends and forming an extension of said ironing board surface;

means for supporting said panel in said outwardly extending position;

means for retracting said panel through an opening in said opposite side wall;

an elongated ironing board pad foldable into sections one on top of the other so as to fit inside said suitcase enclosure; and means for detachably mounting said pad onto the outer side of said closed ends of said suitcase sections forming said ironing board surface and said panel comprising Velcro strips affixed to the underneath side of said pad and to said closed ends and said panel.

* * * * *